US005085578A

United States Patent [19]

Hunter

[11] Patent Number: 5,085,578

[45] **Date of Patent: * Feb. 4, 1992**

[54] CHILD-RESISTANT LIGHTER WITH GAS AND SPARK CONTROL

[76] Inventor: Robert M. Hunter, 320 S. Willson Ave., Bozeman, Mont. 59715

[ * ] Notice: The portion of the term of this patent subsequent to May 21, 2008 has been disclaimed.

[21] Appl. No.: 594,091

[22] Filed: Oct. 9, 1990

Related U.S. Application Data

[63] Continuation-in-part of Ser. No. 421,786, Oct. 16, 1989, Pat. No. 5,017,128.

[51] Int. Cl.[5] ..... F23D 11/36

[52] U.S. Cl. ..... 431/277; 431/153

[58] Field of Search ..... 431/153, 277, 344

[56] References Cited

U.S. PATENT DOCUMENTS

| | | | |
|---|---|---|---|
| 2,520,328 | 8/1950 | Nissen | 431/153 X |
| 4,717,335 | 1/1988 | Loveless | 431/277 |
| 4,784,601 | 11/1988 | Nitta | 431/277 X |
| 4,822,276 | 4/1989 | Bisbee | 431/277 X |
| 5,017,128 | 5/1991 | Hunter | 431/277 |

*Primary Examiner*—Carl D. Price

[57] ABSTRACT

The child-resistant feature comprises a combination lock mechanism that incorporates at least one directly manipulated member, and, in some embodiments, at least one indirectly movable member. Some embodiments incorporate a feature that arrests rotation of the spark wheel when the thumb lever is locked in the child-resistant condition.

9 Claims, 2 Drawing Sheets

CHILD-RESISTANT LIGHTER WITH GAS AND SPARK CONTROL

The present application is a continuation in part of copending application Ser. No. 421,786 filed Oct. 16, 1989, now U.S. Pat. No. 5,017,128 and entitled *Child-Resistant Disposable Lighter with Spark Wheel Arrester.*

FIELD OF INVENTION

This invention relates to the field of child-resistant lighters and, more particularly, to the field of child-resistant disposable lighters of the flint and spark wheel variety.

BACKGROUND

Portable, hand-held lighters are used to ignite combustible materials, typically cigarettes and cigars. Such lighters comprise a fuel in a reservoir, a means of exposing the fuel to air and a means of igniting the fuel. One class of lighters, disposable lighters, require particular caution in their use. These lighters are typically constructed of injection molded thermoplastic and contain a fuel, such as butane, that is normally a gas at atmospheric pressure. In these lighters, the fuel is stored under pressure in a liquid state. Its unauthorized discharge into the air and ignition can cause an explosion. Because of potential hazards associated with explosion. Because of potential hazards associated with unauthorized use of disposable lighters, it is likely that the United States Consumer Product Safety Commission will require that they be made child resistant.

Conventional, disposable lighter designs require two actions for their use. First, a valve on a discharge tube leading from the fuel reservoir to the discharge nozzle must be opened. Second, the gaseous fuel exposed to the oxygen in the air after it is released through the discharge nozzle must be ignited, typically by means of a spark. In conventional, disposable lighter designs, both of the actions required for use are accomplished by grasping the body of the lighter in the palm of the hand with the top of the lighter and the thumb oriented upward and by making a downward motion with the tip of the thumb. The downward motion of the tip of the thumb accomplishes opening of the valve on the discharge tube and ignition of the gaseous fuel.

In conventional flint and spark wheel type lighters, the downward motion of the tip of the thumb pushes down one end of a small lever. The other end of the lever is thereby caused to rise, pulling upward on the valve on discharge tube and opening it. The same downward motion of the tip of the thumb rotates a spark wheel. Rotation of the spark wheel causes its circumference to rub against a sparking medium, such as flint, which emits sparks in the direction of the discharging gas stream.

Both the discharge of the gaseous fuel and the emission of sparks can create hazards, alone and in concert. Mixture of the gaseous fuel with air creates a flammable mixture. Emission of the sparks can ignite this flammable mixture or other flammable substances in the vicinity of the lighter. Both occurrences must, therefore, be controlled to ensure the safety of the lighters in the hands of children.

A variety of child-resistant disposable flint and spark wheel lighter designs have been proposed. In general, these designs use locking mechanisms either to prevent children from opening of the valve on the discharge tube leading from the fuel reservoir or to prevent children from generating a spark. Examples of the first type of design include those disclosed in U.S. Pat. Nos. 4,830,603 (Cirami) and 4,832,596 (Morris). Examples of the second type include those disclosed in U.S. Pat. Nos. 4,717,335 (Loveless) and 4,822,276 (Bisbee). To date, a child-resistant disposable lighter design that prevents both operations necessary for lighter ignition has not been disclosed.

NATURE OF THE INVENTION

The present invention provides a child-resistant lighter with both gas control and spark control. The preferred embodiments of the invention involve improving conventional disposable lighters by adding features that make it difficult for children to open the lighter gas valve and produce the spark required for ignition.

For the purposes of this disclosure, the axis of the lighter body is defined as the vertical axis through the center of the lighter body when the lighter is held upright. In all instances, linear movement of the rotatable part (along its axis of rotation) between rotations is not required. Thus, all of the embodiments disclosed herein call for the movable part to be moved in one kind of motion (i.e., rotation in one plane).

A lighter having a lighter body, a portion of which contains a compressed, flammable fluid, a valve on an opening in said body portion that allows the fluid to discharge from said body portion, a depressible means for opening and closing said valve (e.g., a thumb lever), and a rotatable means for igniting said discharged fluid (e.g., a spark wheel), both of said means requiring at least one motion to operate (e.g., a downward movement of the thumb) is improved to provide child resistance. An example of such an improvement is at least one first rotatable part (e.g., a wheel) for blocking the motion of at least said depressible means for opening and closing said valve, said blocking action occurring only when said first rotatable part is in at least one position, the locked position. The rotatable part may directly or indirectly block the movement. The rotatable wheel is capable of being moved to a plurality of positions by rotation. At least one of these positions causes the blocking action. The first rotatable part is movably attached to said lighter body, and the movement of the rotatable part occurs only in a single plane of rotation about an axis parallel to the axis of said lighter body. The axis of rotation may or may not be coincident with the longitudinal axis of a linear element extending downward into the lighter body. Blocking of the motion of the thumb lever occurs while both the depressible means for opening and closing said valve and the spark wheel are accessible to attempts at manual manipulation. This strategy allows a child operator to incorrectly conclude that normal lighter operation is possible. Research by the inventor has shown that child resistance of packaging is increased by providing many incorrect "solutions" to the problem of package unlocking and only one correct solution.

Incorporation of a child-resistant feature into disposable lighters would increase the safety of such devices. Disposable lighters on the market today typically rely on a linear, axial, downward motion to both turn on the butane gas supply and ignite the gas. In the flint and spark wheel lighter types, a downward motion of the thumb simultaneously depresses a lever that turns on the butane supply and spins the spark wheel which ignites the gas.

One technique by which child resistance could be incorporated into disposable lighters would be to add an element to the devices that would prevent or block the above described downward motion from being accomplished by children. Of course, the design of the element would have to be such that adults could easily manipulate it to allow operation of the lighter.

It is an object of this invention to improve conventional disposable lighter designs by providing child resistance. It is a further object of this invention to disclose a child-resistant disposable lighter technology having child-resistance that is cognitive skill based. Cognitive skill based child-resistance relies on differences in the ways that children and adults think rather than on presumed differences in strength or manual dexterity between children and adults.

It is an object of this invention to incorporate a feature that arrests the spark wheel of a lighter when the lighter lever and gas valve are locked in a child-resistant condition. It is also an object not to deny access to the lever or spark wheel when the lighter is in the child-resistant condition, thus, giving children the impression that the lighter is operable when, in fact, it is not.

Additional objects and features of the invention will appear from the following description in which the preferred embodiments have been set forth in detail in conjunction with the accompanying drawings.

BRIEF DESCRIPTION OF THE DRAWINGS

These features will be better understood by reference to the accompanying drawings which illustrate presently preferred embodiments of the invention.

In the drawings.

DETAILED DESCRIPTION

Figure 1:
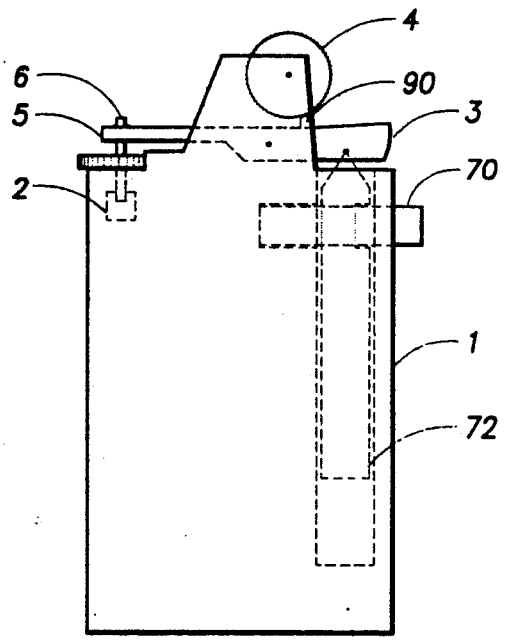
FIG. 1 is a side elevation view of a flint and spark wheel lighter having a locking mechanism comprised of at least one rotatable wheel.
Figure 2:
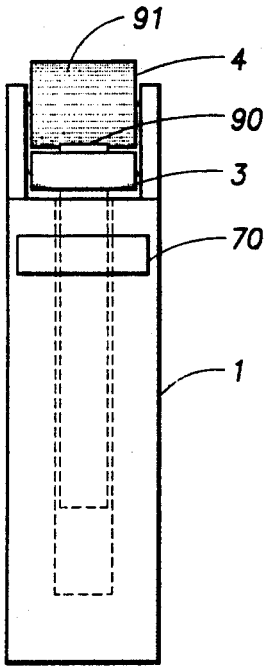
FIG. 2 is another side elevation view of the same flint and spark wheel lighter shown in FIG. 1.
Figure 3:
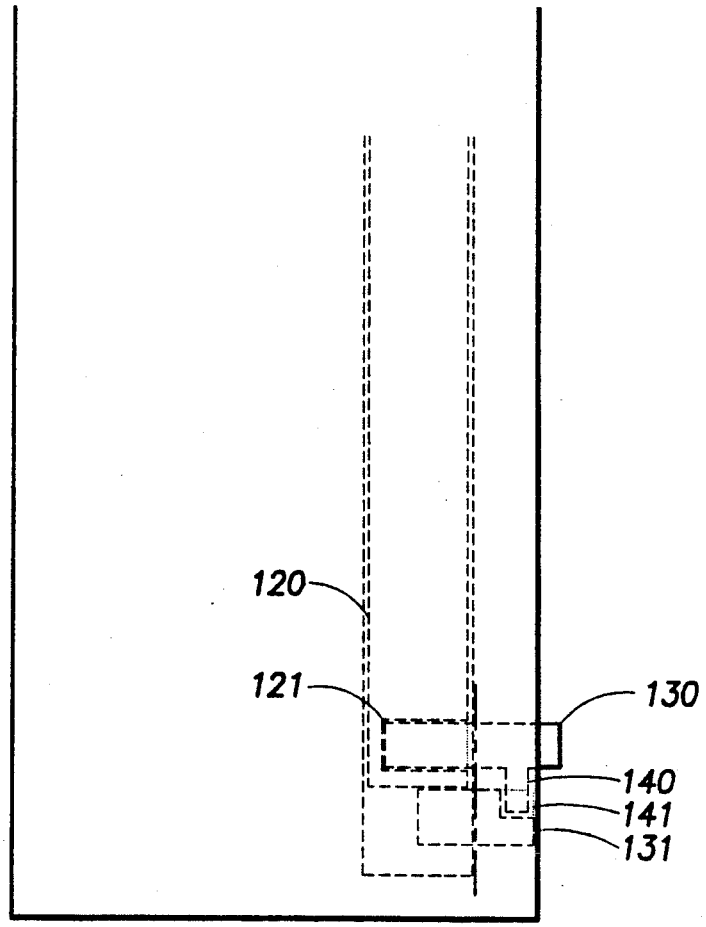
Figure 4:
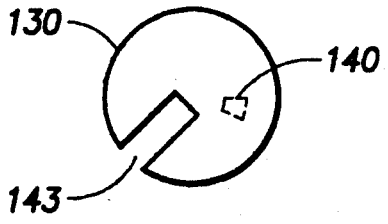
Figure 5:
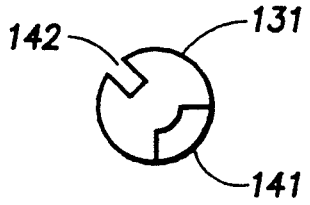

An embodiment of the invention wherein the locking mechanism comprises at least one rotatable wheel is presented in FIGS. 1 and 2. In this embodiment the axis of rotation of the rotatable wheel 70 is coincident with the axis of linear element 72. The at least one rotatable wheel 70 has a hole at its center that is circular except for a notch in the circumference of the otherwise circular hole. In one position of rotation, rotatable wheel 70 is capable of accommodating all cross sections of linear element 72. In all other positions, the hole in rotatable wheel 70 is capable of accommodating only the portion of linear element 72 that is presented to it when linear element 72 is in the upward, locked position.

Also shown in FIGS. 1 and 2 is projection, tooth, serration or friction pad 90 which engages with teeth 91 to prevent rotation of spark wheel 4 when the lighter is in the locked condition. Projection, tooth, serration or friction pad 90 may be integrally molded on lever 3. Alternatively, it may be attached to lever 3 by welding or gluing. Teeth 91 may be mounted on spark wheel 4 as shown or teeth 91 may be otherwise connected with spark wheel 4.

Depression (movement downward) of lever 3 disengages projection, tooth, serration, or friction pad 90 from teeth 91. Of course, this modification is applicable to lighters incorporating other means of blocking the motion of the lever.

The invention is not to be construed as limited to the particular forms disclosed herein, since these are to be regarded as illustrative rather than restrictive. It is the intention of this patent to cover all changes and modifications of the example of the invention herein chosen for the purposes of the disclosure, which do not constitute departures from the spirit and scope of the invention.

I claim:

1. A flint and spark wheel lighter improved to provide child resistance having a lighter body, a portion of which contains a compressed, flammable fluid, a valve on an opening in said body portion that allows the fluid to discharge from said body portion, depressible means for opening and closing said valve, and rotatable means for igniting said discharged fluid, the improvement comprising means for preventing the rotation of said rotatable means for igniting, said means for preventing being attached to said means for opening and closing said valve, and said means for preventing being engagable with said rotatable means for igniting, wherein said means for preventing allows the rotation of said rotatable means for igniting only when said depressible means for opening and closing said valve is depressed and said means for preventing is disengaged from said rotatable means for igniting.

2. The lighter of claim 1 wherein the means for preventing is an element selected from the group consisting of a projection,
a tooth and,
a serration.

3. The lighter of claim 1 wherein the rotatable means for igniting is a spark wheel.

4. The lighter of claim 3 wherein the means for preventing is an element selected from the group consisting of a projection,
a tooth and,
a serration.

5. The lighter of claim 1 wherein the means for opening and closing said valve is a thumb lever.

6. A flint and spark wheel lighter having a lever that must be depressed and a spark wheel that must be separately rotated to operate, said lighter improved to provide child resistance, the improvement comprising means for preventing the rotation of said spark wheel fixed to said lever, wherein said means for preventing allows the rotation of said spark wheel only when said lever is depressed and said means for preventing is removed from contact with said spark wheel.

7. A flint and spark wheel lighter having a lever that must be depressed to operate said lighter improved to provide child resistance, the improvement comprising means for blocking the depression of said lever, said means for blocking being mounted on said lighter, means for preventing the rotation of said spark wheel, said means for preventing being fixed to said lever, wherein said means for preventing allows the rotation of said spark wheel only when said lever is depressed and said means for preventing is disengaged from said spark wheel.

8. The lighter of claim 7 wherein the means for blocking is a wheel.

9. The lighter of claim 7 wherein the means for preventing is an element selected from the group consisting of a projection,
a tooth and,
a serration.

* * * * *